US006056214A

United States Patent [19]

DeGrace, Jr.

[11] Patent Number: 6,056,214

[45] **Date of Patent: *May 2, 2000**

[54] FUEL INJECTOR

[75] Inventor: Louis G. DeGrace, Jr., Newport News, Va.

[73] Assignee: Siemens Automotive Corporation, Auburn Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/976,283

[22] Filed: Nov. 21, 1997

[51] Int. Cl.[7] ..... B05B 1/30

[52] U.S. Cl. ..... 239/585.5; 239/585.1; 251/129.01

[58] Field of Search ..... 239/585.1–585.5; 251/129.01

[56] References Cited

U.S. PATENT DOCUMENTS

| | | | |
|---|---|---|---|
| 3,913,537 | 10/1975 | Ziesche et al. | 239/585.5 X |
| 4,129,254 | 12/1978 | Bader, Jr. et al. . | |
| 4,231,525 | 11/1980 | Palma | 239/585.4 X |
| 4,394,973 | 7/1983 | Sauer et al. | 239/585.2 X |
| 4,454,990 | 6/1984 | Lewis . | |
| 4,711,397 | 12/1987 | Lahiff . | |
| 4,725,041 | 2/1988 | Chauvin et al. | 239/585.4 X |
| 4,805,837 | 2/1989 | Brooks et al. . | |
| 4,810,985 | 3/1989 | Mesenich . | |
| 4,917,352 | 4/1990 | Hauet et al. . | |
| 4,932,593 | 6/1990 | Kiracofe et al. . | |
| 4,982,902 | 1/1991 | Knapp et al. . | |
| 4,995,559 | 2/1991 | Okamoto et al. | 239/585.4 X |
| 5,012,982 | 5/1991 | Souma et al. . | |
| 5,033,716 | 7/1991 | Mesenich . | |
| 5,044,563 | 9/1991 | Mesenich | 239/585.4 |
| 5,192,048 | 3/1993 | Wakeman | 239/585.5 X |
| 5,244,180 | 9/1993 | Wakeman et al. | 239/585.5 X |
| 5,255,855 | 10/1993 | Maier et al. | 239/585.4 |
| 5,307,997 | 5/1994 | Wakeman | 239/585.3 X |
| 5,542,610 | 8/1996 | Augustin . | |

FOREIGN PATENT DOCUMENTS

| | | |
|---|---|---|
| 34 39 671 A1 | 4/1986 | Germany . |
| 196 02 288 A1 | 8/1996 | Germany . |

*Primary Examiner*—Kevin Weldon

[57] ABSTRACT

A fuel injector having pressure equalization passages is provided to equalize the pressure differential across an armature in high vapor pressure fuels. At least one through passage is included that extends from a chamber beneath the armature to a chamber atop the armature to prevent differential pressure buildup when the injector is closed. The passages enable communication between the areas above and below the armature to rapidly equalize the pressure acting on the armature as the boiling bubbles burst and the fuel "explodes".

10 Claims, 2 Drawing Sheets

FUEL INJECTOR

BACKGROUND OF THE INVENTION

This invention relates to fuel injectors and more particularly to a fuel injector in which the pressures across the armature must be equalized.

During hot soak of liquid petroleum gas (LPG) and other high vapor pressure fuel vehicles having spark ignition, port injected engines, vapor leakage from the tips of the fuel injectors can fill the intake manifolds. This condition results in long starting times and can be attributed to a number of factors. For example, the manifold may fill with LPG vapors, little or no air may be present to support combustion, and the injectors may not be metering properly since they are calibrated to meter liquid; but may be filled with vapor.

Observations of injector rails and pods which were lifted out of intake manifolds during hot soak have shown that the injectors were being caused to open momentarily on a random basis during the hot soak period. This random nature of injector opening suggests that the filling of the intake manifold by vapor is not only due to simple leakage from the fuel injectors, but is largely caused by the fuel injectors opening when the engine is not running, and the injectors are under pressure. It seems likely that the displacement of this vapor is caused as a result of violent boiling of the high vapor pressure fuel in the fuel injector which creates a pressure differential across the armature, causing the armature to move, and thus open the valve. This phenomenon can occur because these high vapor pressure fuels can boil violently at relatively low temperatures.

Although vehicles which do not use these high vapor pressure fuels have been observed to have undesirable vapor formation in injectors as a result of engine heat, these vapors do not boil and "explode" as do the high vapor pressure fuels. Thus, the formed vapors are generally transported away from the injector by flushing them away in the return fuel through a fuel return path, as disclosed in U.S. Pat. No. 4,711,397 issued to Lahiff and U.S. Pat. No. 4,982,902 issued to Knapp et al. Although these vapor removal techniques are satisfactory for typical low vapor pressure fuels, such techniques do not address the problem of equalizing the pressure differentials created across an armature as a result of the violent boiling of high vapor pressure fuels.

It is therefore an object of the present invention to provide a fuel injector in which the differential pressure which typically occurs across the armature in vehicles using high pressure fuels can be avoided in order to reduce or eliminate the resulting liquid or vapor leakage from the fuel injector tip into the intake manifold.

SUMMARY OF THE INVENTION

The above-recited objects are achieved by providing a fuel injector, typically a bottom fed injector calibrated for LPG applications, having at least one through passage that extends from a chamber beneath the armature to a chamber atop at least a portion of the armature to prevent differential pressure buildup when the injector is closed. The passages enable communication between the areas above and below the armature to rapidly equalize the pressures acting on the armature as the boiling bubbles burst and the fuel "explodes". Without the presence of the pressure equalizing passages the armature momentarily lifts the needle when the bubble bursts under the armature, and relatively large amounts of fuel are admitted into the intake manifold during hot soak. When this happens, the manifold can fill with vaporized fuel, making hot start difficult or impossible, depending on the exact conditions in the manifold. The number, size and placement of the passages are determined as a function of the anticipated pressure differential across the armature, depending on the specific application.

DETAILED DESCRIPTION

Figure 1:
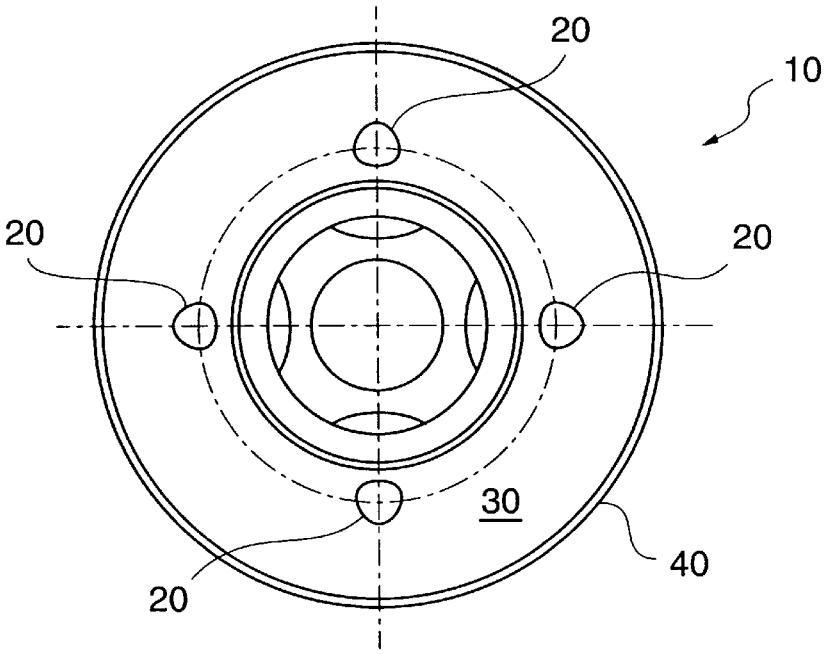
FIG. 1 is a top schematic view of the top area of the valve body of a fuel injector according to the present invention.
Figure 2:
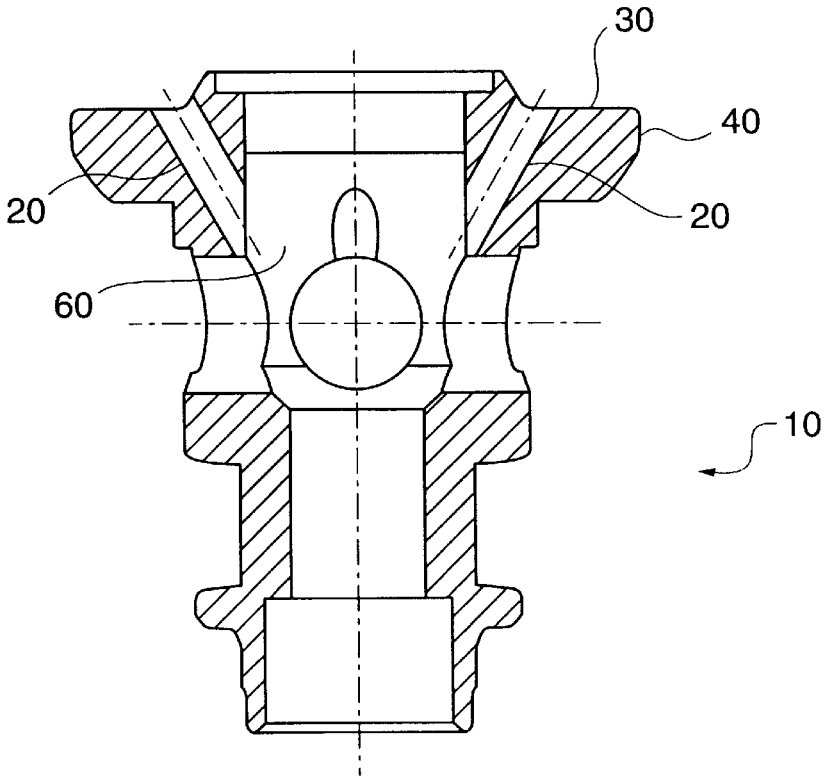
FIG. 2 is a cross sectional view of the valve body of FIG. 1.
Figure 3:
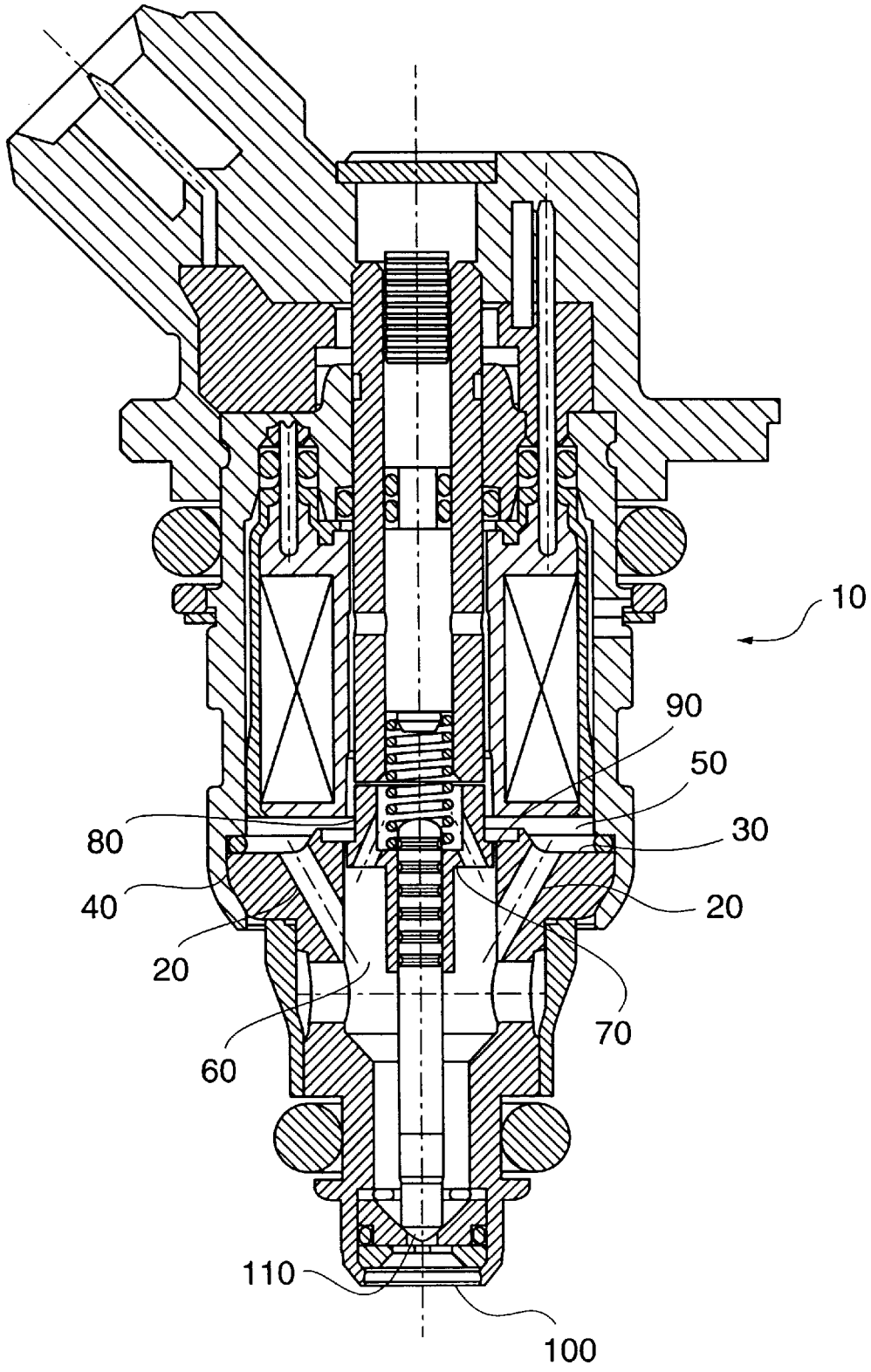
FIG. 3 is a more detailed cross sectional view of a fuel injector having pressure equalization passages according to the present invention.

As shown in FIGS. 1 and 3, the fuel injector 10 has a plurality of pressure equalization passages 20 spaced around the top surface 30 of the valve body 40 and communicating with an upper chamber 50 and a lower chamber 60. As can be seen more clearly in FIGS. 2 and 3, the lower chamber 60 is partially defined by the bottom surface 70 of the armature 80 and the upper chamber 50 is partially defined by the upper flange surface 90 of the armature 80. Thus, the passages 20 permit vapor to move rapidly between the upper chamber 50 and the lower chamber 60 so that pressures acting on the bottom surface 70 and the upper flange surface 90 of the armature 80 in the chambers 50,60 are quickly equalized. As can be seen from FIG. 3, without the presence of the passages 20, a sudden increase in pressure in the lower chamber 60 would cause the armature 80 to travel upward, and permit the escape of vapor from the tip 100 of the fuel injector 10 as the injector needle 110 was lifted by the armature 80.

As shown in FIG. 1, the fuel injector 10 has four substantially equally and angularly spaced pressure equalization passages 20 connecting the chambers 50, 60. However, the number of passage 20 may vary as desired to achieve the desired rate of pressure equalization between the chambers 50, 60. Although a passage diameter of about one mm is suitable for most fuel injectors having four passages 20, there can be one or a plurality of passages, as long as the number and size of passages 20 permit sufficiently rapid pressure equalization between the chambers 50,60 to prevent the armature from being lifted by the violent boiling action of the fuel in the bottom chamber 60 of the fuel injector 10.

It is understood that, while the detailed description and drawings show specific examples of the present invention, they are for purpose of illustration only. The present invention is not limited to the precise details and conditions disclosed. For example, linear passages operate most efficiently, but the passages may be non-linear if desired or required by design constraints of the injector. In addition, when the valve body has a plurality of passages, the passages can be unequally spaced. The passages can also be unequally sized and spaced, such that the diameters of the plurality of passageways varies from one to another.

What is claimed is:

1. An electromagnetic fuel injector for high vapor pressure fuels, said fuel injector comprising:

a housing;

a valve body partial disposed with the housing, the valve body including an exterior surface, a first end surface, a second end surface, a passage extending between the first end surface and the second end surface along a longitudinal axis;

an armature slidably disposed in the passage of the valve body, the armature having a portion defining a lower chamber with the passage between the armature and the second end surface, and an upper chamber proximate the first end surface of the valve body and within the housing, the armature including at least one aperture exposed to the lower chamber that assists armature movement during a commanded armature movement;

at least one port disposed within the valve body, the at least one port providing communication between the exterior surface of the valve body and the passage of the valve body, the at least one port being exposed to the lower chamber; and at least one passageway disposed in the valve body, the at least one passageway providing communication between the lower chamber and the first end surface, the at least one passage way also providing rapid equalization of pressure between the lower chamber and the upper chamber so that an uncommanded armature movement is avoided.

2. The fuel injector of claim 1, wherein the fuel injector comprises a bottom-feed injector.

3. The fuel injector of claim 1, wherein the at least one passageway comprises a plurality of passageways.

4. The fuel injector of claim 3, wherein the plurality of passageways are substantially equally and angularly spaced about the armature.

5. The fuel injector of claim 4, wherein the plurality of passageways comprises four passageways, each of the passageways being about one mm in diameter.

6. A method of forming a pressure balanced electromagnetic fuel injector for high vapor pressure fuels, said injector having an armature slidably disposed in a valve body, and having a lower chamber below the armature and an upper chamber above at least a portion of the armature, comprising the step of:

locating the armature in a passage of the valve body to define the lower chamber and the upper chamber, the lower chamber being located within the passage, and the upper chamber being located within a housing that surrounds the valve body, the upper chamber being proximate the armature and the valve body;

providing at least one aperture in the armature exposed to the lower chamber that assists armature movement during a commanded armature movement; and providing at least one passageway extending through the valve body from the lower chamber to the upper chamber, said at least one passageway being sized to permit rapid pressure equalization between the lower chamber and the upper chamber so that uncommanded actuated armature movement is avoided.

7. The method of claim 6, wherein a bottom feed fuel injector is provided as the fuel injector.

8. The method of claim 6, wherein the step of providing further comprises providing a plurality of passageways as the at least one passageway.

9. The method of claim 8, wherein the plurality of passageways are substantially equally and angularly spaced about the plurality of the armature.

10. The method of claim 9, wherein the plurality of passageways comprise four passageways, each of the passageways being about one mm in diameter.

* * * * *